United States Patent [19]

Bragg et al.

[11] Patent Number: 4,886,367

[45] Date of Patent: Dec. 12, 1989

[54] APPARATUS FOR ADDING A SELECTED ADDITIVE INTO A MIXTURE

[75] Inventors: Dale E. Bragg; Mark A. Clark; Randy G. Fleming, all of Duncan, Okla.

[73] Assignee: Halliburton Company, Duncan, Okla.

[21] Appl. No.: 200,085

[22] Filed: May 27, 1988

[51] Int. Cl.[4] ..... B01F 15/02

[52] U.S. Cl. ..... 366/132; 137/101.19; 222/57; 222/135; 366/134; 366/152; 366/177; 364/550

[58] Field of Search ..... 366/64, 65, 43, 45, 366/46, 53, 92, 94, 95, 40, 131, 132, 142, 150, 151, 152, 153, 177, 237, 238, 240, 134; 137/101.19, 268, 88, 91; 222/1, 135, 55, 57, 52; 364/172, 479, 502, 550, 556

[56] References Cited

U.S. PATENT DOCUMENTS

| | | | |
|---|---|---|---|
| 2,873,036 | 2/1959 | Noble | 214/2 |
| 3,481,544 | 12/1969 | Jackson | 239/130 |
| 4,265,266 | 5/1981 | Kierbow et al. | 137/101.19 |
| 4,353,482 | 10/1982 | Tomlinson et al. | 222/57 |
| 4,357,110 | 11/1982 | Hope et al. | 366/132 |
| 4,410,106 | 10/1983 | Kierbow et al. | 222/135 |
| 4,427,133 | 1/1984 | Kierbow et al. | 222/77 |
| 4,432,064 | 2/1984 | Barker et al. | 364/550 |
| 4,433,701 | 2/1984 | Cox et al. | 137/101.19 |
| 4,474,476 | 10/1984 | Thomsen | 366/152 |
| 4,538,221 | 8/1985 | Crain et al. | 364/172 |
| 4,538,222 | 8/1985 | Crain et al. | 364/172 |
| 4,654,802 | 3/1987 | Davis | 364/502 |
| 4,701,095 | 10/1987 | Berryman et al. | 414/332 |
| 4,715,721 | 12/1987 | Walker et al. | 366/132 |
| 4,747,060 | 5/1988 | Sears, III et al. | 364/481 |
| 4,751,648 | 6/1988 | Sears, III et al. | 364/422 |
| 4,779,186 | 10/1988 | Handke et al. | 364/172 |
| 4,835,701 | 5/1989 | Ohiwa et al. | 364/502 |

OTHER PUBLICATIONS

Dowell Schlumberger, "Precision Meets Dependability for the Perfect Mix. Introducing the Pod Blender, Only From Dowell Schlumberger.", date unknown.

Dowell Schlumberger, "The Pod Has Landed", date unknown.

Halliburton Services Cementing Technical Data brochure, "Lanmarc System", [C-1333(Rev.)], date unknown.

Halliburton Services General Technical Data Sheet, "Automatic Proppant Control System (APCS)", [G-9156(Rev.)], date unknown.

*Primary Examiner*—Timothy F. Simone

*Attorney, Agent, or Firm*—James R. Duzan; E. Harrison Gilbert, III

[57] ABSTRACT

A complete additive transport and mixing system is carried on a single vehicle. A collection of liquid additive containers, a collection of metering devices, and a mixing system are all mounted on the vehicle, as is a dry additive metering device. A selected liquid additive container can be selectably and changeably connected to a selected liquid additive metering device, and a selected liquid additive metering device can be selectably and changeably connected to a selected input into the mixing system. The metering of the liquid additives is monitored and a concentration display given so that the metering devices can be manually controlled to obtain an actual concentration equal to a desired concentration. A display indicating a desired setting for the dry additive metering device is also given so that the dry additive metering device can be manually controlled to allow a suitable amount of the dry additive to be added into the mixing system to obtain a desired concentration of the dry additive.

16 Claims, 3 Drawing Sheets

APPARATUS FOR ADDING A SELECTED ADDITIVE INTO A MIXTURE

BACKGROUND OF THE INVENTION

This invention relates generally to apparatus and methods for adding one or more selected additives into a mixture and more particularly, but not by way of limitation, to a portable apparatus and a method for mixing a liquid additive and a proppant with a base liquid to prepare at a well site a mixture for use in a well.

During construction activities, for example, mixtures of materials sometimes need to be prepared. With specific reference to drilling and completing an oil or gas well, acidizing and fracturing fluids, as well as cements and gels, sometimes need to be provided at the well site for well-known purposes. Such mixtures can be needed in various quantities and compositions.

To provide such a mixture to a well site, a batch of the anticipated desired composition and quantity can be prepared and then transported to the well site. An example of this is a 4000-gallon bulk acid transport truck. Alternatively, the components of the ultimate mixture can be carried to the well site and there mixed in separate equipment which has also been transported to the well site. These techniques typically produce batches of the mixture. This can produce waste, and expense to the customer, if the well cannot be prepared in time to use the batch or if significantly less than the entire batch is needed in the well. These techniques also typically require more than one piece of equipment to be transported to the well site. This, too, can increase the costs to the customer by way of the additional equipment and the additional manpower to operate it.

In view of these characteristics of the techniques by which mixtures are typically provided to a well site, it would be desirable to provide a technique wherein local mixing "on the fly" (i.e., as the mixture is needed and pumped into the well) would be performed for a specific job. This would obviate the necessity of anticipating ultimate needs and specific timing as must be done when a batch is premixed well before it is actually needed. Creating the needed mixture locally and on the fly would thus likely prevent the waste which can result from the technique whereby a mixture is batched beforehand. To obviate the need for multiple pieces of equipment to be transported separately to the well site, it would also be desirable for the new technique to be a single compact, portable integrated system capable of transporting the needed components, mixing them as needed, and providing control information by which the mixing process can be controlled.

Although it would be desirable to have such a single compact, portable integrated system of any suitable type, it would be preferred to have such a system be versatile so that a variety of mixtures can be produced. This versatility should include the ability to have individual additives or combinations of additives selected for use in producing the mixture. Such versatility should also include the ability to meter one or more selected additives within different, selectable metering ranges. Such versatility should also include the ability to select the location where a selected additive is to be input into the mixing system.

Such an integrated system should also provide for relatively easy control so that operator tasks such as reading and matching meters and consulting additive concentration char ; are no longer necessary. For example, where a particulate proppant and one or more liquid additives are to be added into a mixture, computer technology should be used to compute and display a gate setting and actual concentration values. The gate setting would be used to set a proppant gate by which the amount of proppant added into the mixture is controlled, and the actual concentration values would be used to control the metering of the selected additive(s).

Finally, an apparatus and method meeting each of the foregoing needs should preferably also be relatively simple to construct or implement, and require relatively low maintenance and cost.

SUMMARY OF THE INVENTION

The present invention overcomes the above-noted and other shortcomings of the prior art by providing a novel and improved apparatus and a novel and improved method for adding one or more selected additives into a mixture. Although one or more of the needs mentioned in the preceding section may be met by one or more prior techniques for providing mixtures of materials at a location where needed, such as at a well site, it is believed that no prior system satisfies all the stated needs in the manner in which the present invention satisfies them.

The present invention provides a single compact, portable integrated material transport and mixing system which satisfies all the aforementioned needs. In a preferred embodiment, a truck carries tanks of liquid additives and sacks of dry additive which are to be mixed, on the fly as the resultant mixture is needed and used, in a mixing system also carried on the truck. A selected tank is changeably connected to a selected pump which is changeably connected to a selected input of the mixing system. Other such changeable connections are possible with other inputs disposed at various locations of the mixing system. Flow rates are monitored by microcomputers which use the flow rates and a manually input desired dry additive concentration factor and a manually input dry additive coefficient to compute and display information in response to which an operator manually controls the metering of the liquid and dry additives. These computer-based monitoring and information generating functions are implemented to obviate the need for the operator to read and match needle indicators and then consult one or more charts to learn what the concentrations are or what settings should be made to obtain desired concentrations. The present invention is constructed in the preferred embodiment to be relatively simple and low cost and to require relatively low maintenance.

More generally, the present invention provides an apparatus for adding a selected additive into a mixture. The apparatus comprises: first container means for storing a first additive, the first container means including a first additive outlet; second container means for storing a second additive, the second container means including a second additive outlet; first metering means for moving a substance at a controlled rate, the first metering means including a first metering inlet and a first metering outlet; second metering means for moving a substance at a controlled rate, the second metering means including a second metering inlet and a second metering outlet; mixing means for mixing a plurality of substances into a mixture, the mixing means including a plurality of additive inlets; first connector means for changeably connecting the respective additive outlet of a selected one of the first and second container means to the respective metering inlet of a selected one of the first and second metering means for communicating the respective additive from the selected one of the first and second container means to the selected one of the first and second metering means to be the substance moved thereby; and second connector means for changeably connecting the respective metering outlet of the selected one of the first and second metering means to a selected one of the plurality of additive inlets of the mixing means for communicating the selected one of the first and second metering means with the mixing means through the selected one of the plurality of additive inlets, thereby for providing the respective additive of the selected one of the first and second container means as a substance to be mixed in the mixing means.

In a preferred embodiment the first connector means includes a first hose including coupling means for releasably coupling to the respective additive outlet of the selected one of the first and second container means, and the first hose also includes coupling means for releasably coupling to the respective metering inlet of the selected one of the first and second metering means. The second connector means of this embodiment includes a second hose including coupling means for releasably coupling to the respective metering outlet of the selected one of the first and second metering means, and it also includes coupling means for releasably coupling to the selected one of the plurality of additive inlets of the mixing means. This embodiment further comprises a truck having the first and second container means, the first and second metering means and the mixing means mounted thereon, which truck includes storage means for receiving the first hose when the coupling means thereof are released from the respective additive outlet and the respective metering inlet and for receiving the second hose when the coupling means thereof are released from the respective metering outlet and the selected one of the plurality of additive inlets.

In a particular embodiment, the present invention provides a portable apparatus for mixing a liquid additive and a proppant with a base fluid to prepare at a well site a mixture for use in a well, which apparatus comprises: liquid additive storage means for providing a reservoir for a liquid additive; liquid additive metering means for providing a controlled rate flow of a liquid additive from the liquid additive means; proppant metering means for providing a controlled rate flow of a proppant; mixing means for receiving the controlled rate flow of a liquid additive and the controlled rate flow of a proppant and for mixing the controlled rate flows with a flow of a base fluid to provide a flow of a mixture; first computer means, including means for receiving a desired proppant concentration factor and responsive to the mixing means and to a received desired proppant concentration factor, for computing information with which to control the proppant metering means and for computing a clean flow rate value for the mixture excluding the proppant; and second computer means, responsive to the clean flow rate value and to the liquid additive metering means, for computing a liquid additive concentration value with which to control the liquid additive metering means.

The method of the present invention comprises the steps of: transporting to the well site on a single vehicle a plurality of containers each containing a respective liquid additive and each including an additive outlet, a plurality of liquid additive metering means for providing a metered flow of a liquid additive each including a metering inlet and a metering outlet, and mixer means for mixing a metered liquid additive and a base liquid, which mixer means includes a plurality of additive inlets; manually connecting, at the well site, with a first hose the additive outlet of a selected one of the containers and the metering inlet of a selected one of the liquid additive metering means; manually connecting, at the well site, with a second hose the metering outlet of the selected metering means and a selected one of the additive inlets of the mixing means; and controlling, at the well site, the selected metering means to provide a metered flow of the liquid additive of the selected one of the containers so that provided in the mixing means is a mixture having a desired concentration of the liquid additive of the selected one of the containers.

In the preferred embodiment this method further comprises the steps of: setting the size of an opening defined above a tub of the mixing means, including: entering a desired dry additive concentration factor into a computer carried on the single vehicle; determining in the computer a flow rate of the mixture; calculating in the computer, in response to the desired dry additive concentration factor and the flow rate of the mixture, a desired flow rate of dry additive to obtain the dry additive concentration indicated by the desired dry additive concentration factor; displaying indicia representing the calculated desired flow rate of dry additive; and manually adjusting, in response to the displayed indicia, a movable gate disposed above the tub of the mixing means so that the size of the opening defined above the tub is thereby set; and pouring dry additive through the opening and into the tub so that the mixing means mixes a controlled amount of dry additive into the mixture.

In the preferred embodiment, the step of controlling the selected metering means includes entering a dry additive coefficient into the computer; calculating a clean flow rate, including multiplying the dry additive coefficient and the desired dry additive concentration factor to define a product, adding the product to one to define a sum and dividing the sum into the determined flow rate of the mixture; determining the flow rate of the metered liquid additive of the selected one of the containers; calculating, in response to the clean flow rate and the flow rate of the metered liquid additive, the concentration of the metered liquid additive in the mixture; displaying the calculated concentration of the metered liquid additive; and manually adjusting the operation of the selected metering means until the displayed calculated concentration of the metered liquid additive equals a desired concentration thereof.

Therefore, from the foregoing, it is a general object of the present invention to provide a novel and improved apparatus and a novel and improved method for adding one or more selected additives into a mixture. Other and further objects, features and advantages of the present invention will be readily apparent to those skilled in the art when the following description of the preferred embodiment is read in conjunction with the accompanying drawings.

DESCRIPTION OF PREFERRED EMBODIMENT

The present invention provides an apparatus for adding a (i.e., at least one) selected additive into a mixture. The preferred embodiment of this apparatus to be described hereinbelow is particularly adapted for mixing a liquid additive, such as one or more conventional fracturing fluids, and a proppant, such as sand, with a base fluid, such as an aqueous liquid, to prepare at a well site a mixture for use in a well. The particular embodiment to be described was initially designed for mixing diverters on acid jobs; however, it has been adapted in the form described hereinbelow for proppant blending as well as various other mixing applications, including mixing diverters, mixing fracturing fluids, mixing gels and, in general, mixing a wide variety of liquid or dry additives on-the-fly or in batches. It is contemplated that the present invention can be used on or adapted for other types of mixing jobs, whether in the oil and gas industry or otherwise.

Figure 1:
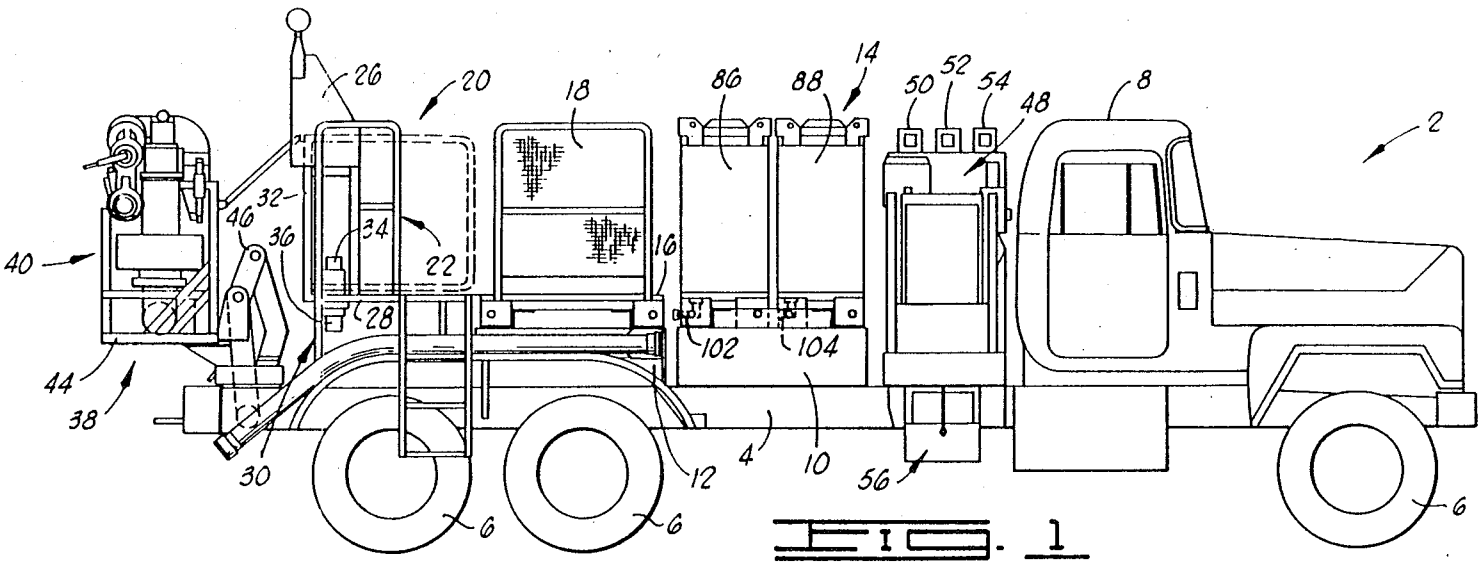
FIG. 1 is a schematic side elevational view of an apparatus which includes the preferred embodiment of the present invention.
Figure 2:
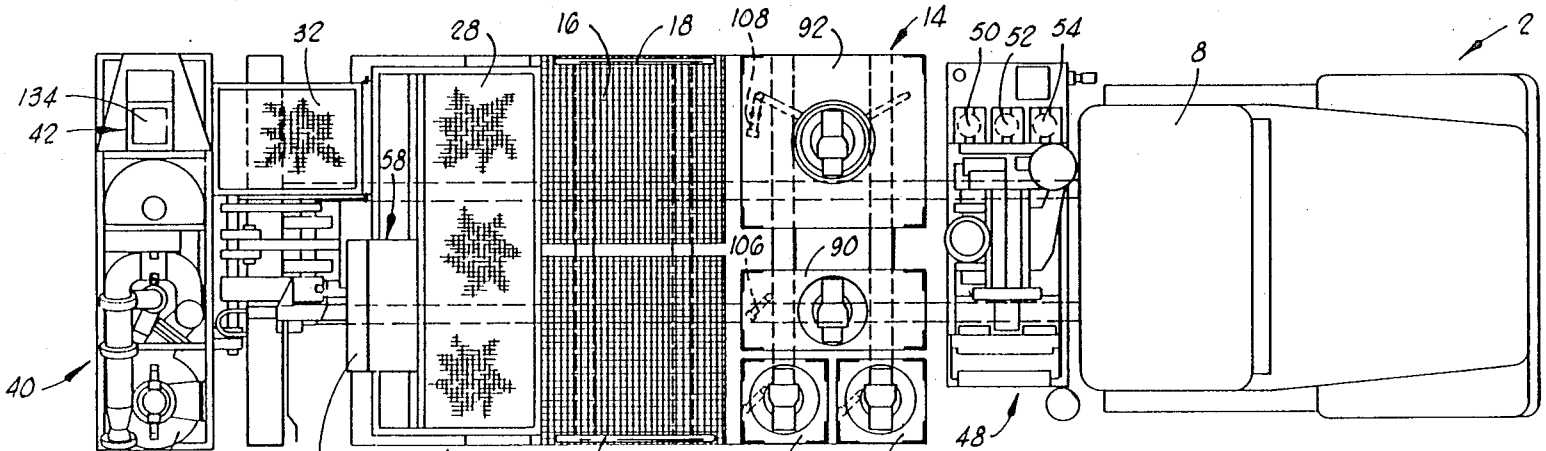
FIG. 2 is a schematic plan view of the apparatus shown in FIG. 1.

The preferred embodiment of the present invention is a truck-mounted apparatus as illustrated in FIGS. 1 and 2; however, the present invention is not limited to being truck-mounted. Any suitable vehicle or mounting suitable for collectively locating the components in a unified manner can be used.

The truck shown in FIGS. 1 and 2 is generally identified by the reference numeral 2. The truck 2 includes a chassis 4 mounted on wheels 6. All of these features are of conventional constructions, but ones suitable for withstanding the harsh environments in which the truck 2 can be used.

Mounted at the front or forward end of the chassis 4 is a conventional driver's cab 8 from which the truck 2 is driven.

Behind the cab 8 there are mounting areas where the additives are stored. A forward mounting area includes a support structure 10 mounted relatively centrally along the chassis 4. A rear mounting area located adjacent the forward support structure 10 includes a support structure 12. In the embodiment illustrated in FIGS. 1 and 2, the support structure 10 supports liquid additive storage means 14 for providing one or more reservoirs for one or more liquid additives. The support structure 12, on the other hand, carries a pallet 16 on which sacks of dry additives can be stored. Side retaining walls 18 are provided at the two outboard sides of the pallet 16. These support structures 10, 12 are, however, constructed so that they can be used for either liquid or dry additive storage.

More rearwardly along the chassis 4, but adjacent the support structure 12 (thereby providing easy access to sacks of dry additives stored on the pallet 16 when so used), there is defined a control station area 20. Located within the area 20 is a control stand 22 on which a control panel 24 (see FIG. 3), contained within a control panel housing 26, is mounted. At the base of the control stand 22 there is located a walkway grill 28 supported above the chassis 4 by a support structure 30 which positions the walkway grill 28 at the same height as the pallet 16. Forming an extension of the walkway grill 28 is a section 32 which pivots between a raised position shown in FIG. 1 and a lowered position shown in FIG. 2.

Mounted in the same area as the control stand 22 are two metering pumps 34, 36 forming part of a liquid additive metering means for providing a controlled rate flow of a liquid additive from the liquid additive storage means 14.

Mounted at the rear of the chassis 4 is lift means 38 for moving a mixing means 40 and a proppant (or, more generally, dry additive) metering means 42 mounted thereon between a raised position adjacent the chassis 4 as shown in FIG. 1 and a lowered position adjacent the ground upon which the truck 2 sits as shown in FIG. 2. The proppant metering means 42, which provides a controlled rate of flow of a proppant (or other dry additive), and the mixing means 40, which receives the controlled rate flow of liquid additive and the controlled rate flow of proppant and mixes them with a flow of a base liquid to provide a flow of a mixture, are mounted on a platform 44 supported by the lift means 38. The platform 44 is supported by a pivoting linkage 46 which is hydraulically actuated to move the platform 44, and the components mounted thereon, between the aforementioned raised and lowered positions. Actuation of the linkage 46 is powered through a hydraulic circuit. An internal combustion engine 48 drives three hydraulic pumps 50, 52, 54 which provide hydraulic fluid to the hydraulic circuit. The engine 48 and the pumps 50, 52, 54 are mounted on the chassis 4 between the cab 8 and the support structure 10, and they provide all the hydraulic power used in operating the system mounted on the truck 2. The details of the hydraulic circuit of the system are not further described herein, other than as described hereinbelow with reference to FIG. 4, because the hydraulic circuitry is used in a conventional manner to produce the hydraulically powered functions which are described herein.

Also carried on the chassis 4 is a storage compartment 56. Another storage compartment is located in the control stand 2 in the area indicated in FIG. 2 by the reference numeral 58.

Figure 4:
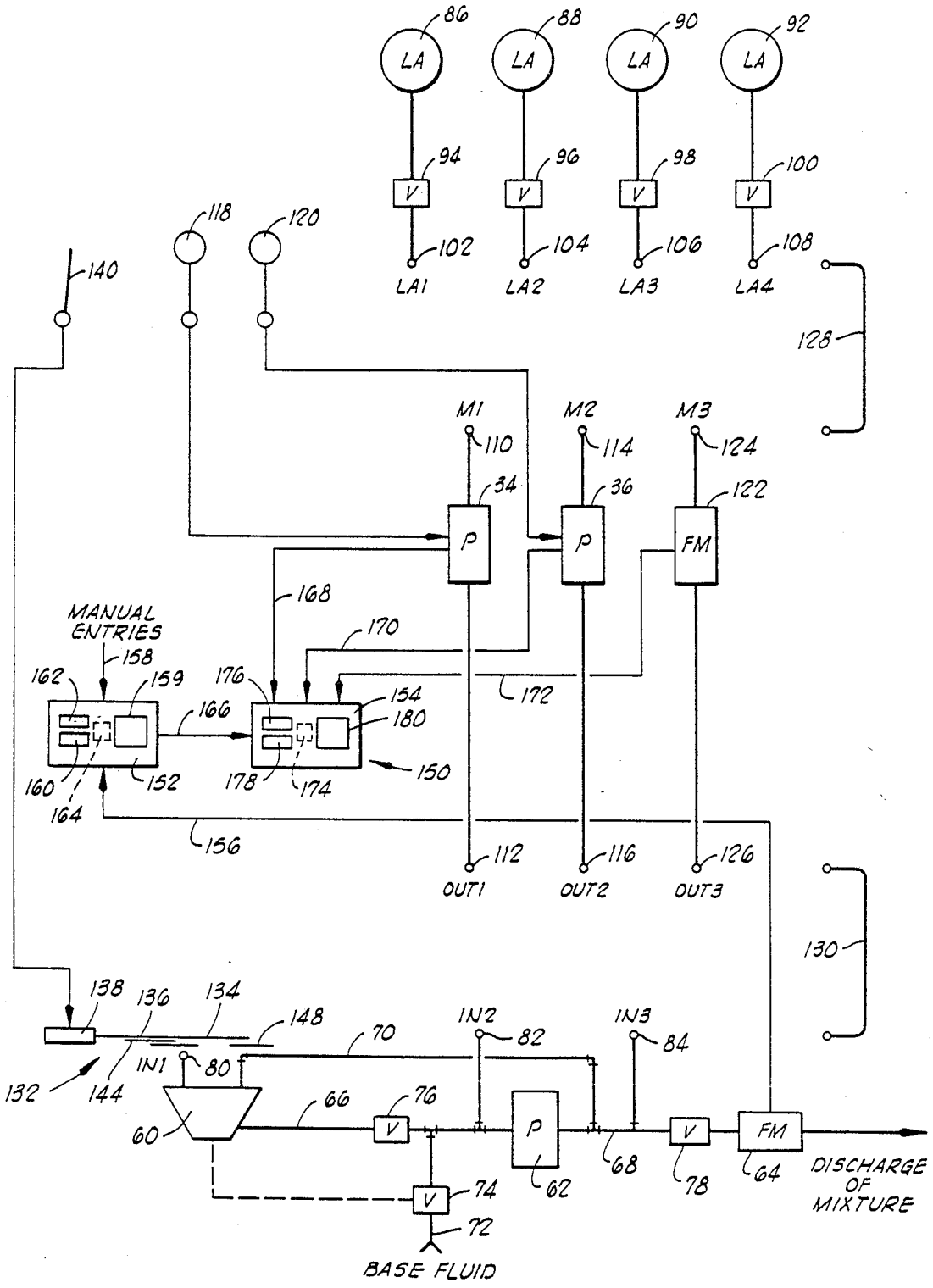
FIG. 4 is a schematic diagram of the additive and mixing and the monitoring and control systems of the apparatus shown in FIGS. 1 and 2.

With reference next primarily to FIG. 4, the mixing means 40, the liquid additive storage means 14, the liquid additive metering means (which includes in the preferred embodiment the pumps 34, 36), connector means for selectably interconnecting the mixing means and the liquid additive storage means and the liquid additive metering means, the proppant metering means 42, and the pertinent parts of the control panel 24 will be described.

The mixing means 40, wherein the additives, such as conventional liquid and dry fracturing fluid additives, are mixed with a base fluid, such as water, includes a novel assembly of components which are particularly described in a copending U.S. patent application entitled "Self-Leveling Mixer Apparatus" of Stegemoeller and Davis, filed concurrently herewith and assigned to the assignee of the present invention, which application is incorporated herein by reference. For purposes of the present invention, however, it is sufficient to expressly state herein only a general description of the mixing system. The mixing system includes a blending tub 60, a centrifugal pump 62 and a flowmeter 64. The system also includes conduit means 66 for conducting a fluid flow from the blending tub 60 to the pump 62, and conduit means 68 for conducting a fluid flow from the pump 62 to the flowmeter 64. There is also a conduit 70 which provides a flow from the conduit 68 back into the blending tub 60. A conduit 72, in which a valve 74 actuated in response to the angular position of the blending tub 60 is disposed, communicates a base fluid into the conduit 66. Disposed in the conduits 66, 68 are manually controlled valves 76, 78, respectively. It is through the valve 78 and the flowmeter 64 that the desired mixture is discharged, such as for flowing into a Halliburton HT-400 pump for pumping the mixture into a well. The flow rate of this mixture is detected in a known manner by the flowmeter 64, which thereupon generates an electrical signal indicating the detected flow rate.

Of particular significance to the present invention are a plurality of additive inlets located throughout the mixing system. In the preferred embodiment three additive inlets 80, 82, 84 are shown in FIG. 4. Each of the additive inlets includes part of a quick release coupling to which a hose or other suitable connector means is releasably coupled as more particularly described hereinbelow. As shown in FIG. 4, the additive inlet 80 communicates into the blending tub 60, the additive inlet 82 communicates into the conduit 66 in between the valve 76 and the pump 62 and also in between the valve 74 and the pump 62, and the additive inlet 84 communicates into the conduit 68 between the pump 62 and the valve 78 and more particularly between the junction of the conduit 70 with the conduit 68 and the valve 78. The additive inlets 80, 82, 84 are used for receiving, through connections subsequently described hereinbelow, one or more liquid additives stored in the liquid additive storage means 14.

In the preferred embodiment depicted in FIG. 4, the liquid additive storage means 14 includes containers for storing the liquid additives, which containers include respective additive outlets. More particularly, there are four tanks 86, 88, 90, 92 having manually operable valves 94, 96, 98, 100, respectively, associated therewith. The container which includes the tank 88 and the valve 94 terminates at a quick-coupling additive outlet 102, the container including the tank 88 and the valve 96 terminates in a quick-coupling additive outlet 104, the container including the tank 90 and the valve 98 terminates at a quick-coupling additive outlet 106, and the container including the tank 92 and the valve 100 terminates at a quick-coupling additive outlet 108. Particular embodiments of the four tanks 86, 88, 90, 92 are depicted in FIGS. 1 and 2; however, these are merely representative in that other types and sizes and configurations of tanks can be used. Even within the preferred embodiment layout of the truck 2 shown in FIGS. 1 and 2, the support structures 10, 12 are designed to hold up to 16 of the smallest illustrated types of tanks identified in the drawings as the tanks 86, 88. To implement this, two of these smallest illustrated tanks would replace the tank 90, four would replace the tank 92, and eight would be located on the pallet 16. Other combinations of tanks are, of course, possible, even for the particular construction of the truck 2 shown in FIGS. 1 and 2. Regardless of what tanks are used, the liquid additives carried in them are metered from the tanks by the liquid additive metering means.

Figure 3:
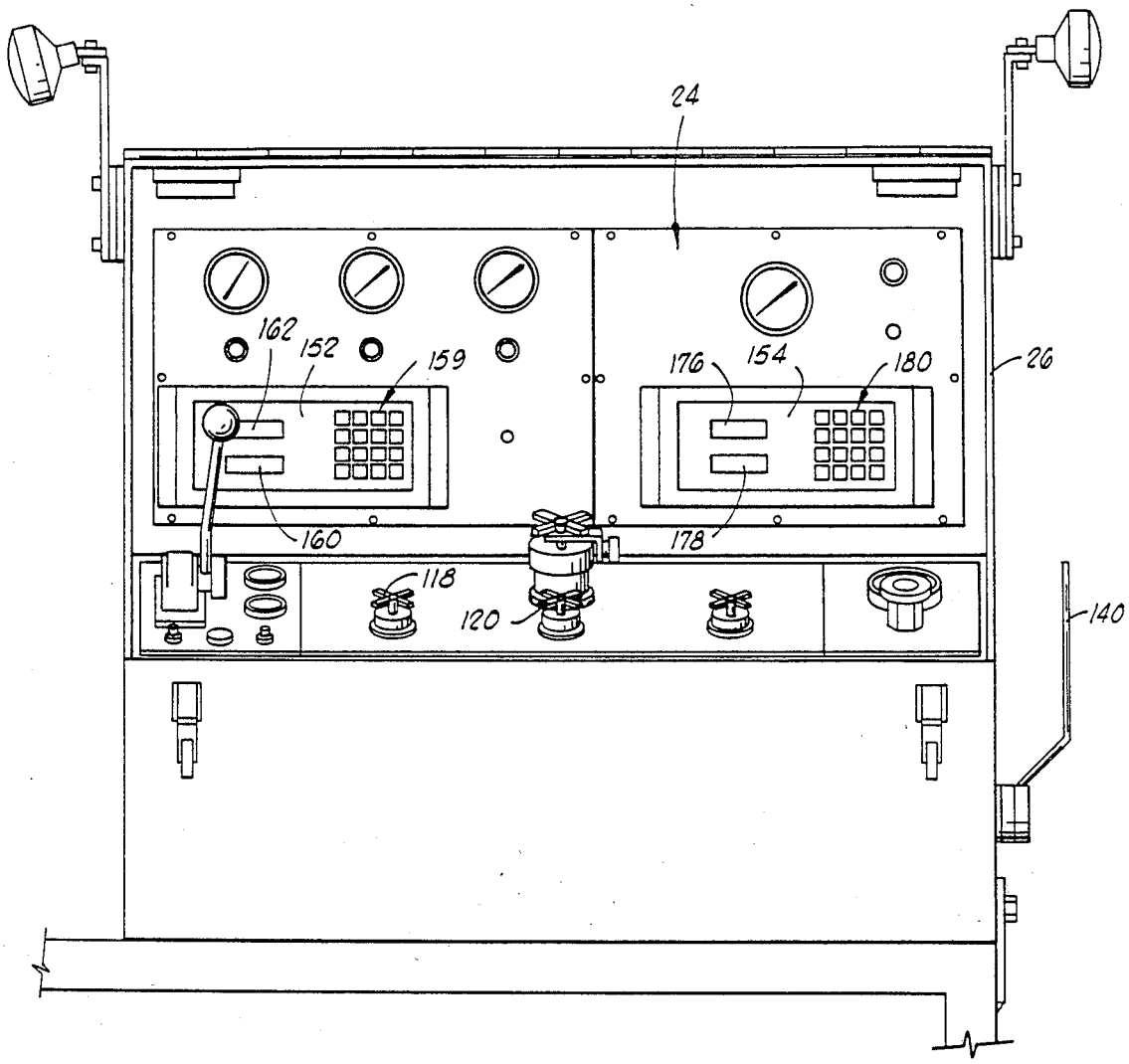
FIG. 3 is a front, open view of a control stand, revealing a control panel thereof, of the apparatus shown in FIGS. 1 and 2.

The liquid additive metering means includes the positive displacement pumps 34, 36. The pump 34 is connected between a metering inlet 110 and a metering outlet 112 so that the pump 34, when appropriately connected and actuated, communicates a flow of a selected liquid additive from the inlet 110 to the outlet 112. The pump 36 is connected between a metering inlet 114 and a metering outlet 116 so that the pump 36, when appropriately connected and actuated, communicates a flow of a selected liquid additive from the inlet 114 to the outlet 116. In the preferred embodiment the pumps 34, 36 are selected to provide different ranges of flows. The pump 34 has a flow rate range of between about 0.1 gallon per minute and about 6 gallons per minute, and the pump 36 has a flow rate range of between about 1 gallon per minute to about 25 gallons per minute. The operation of the pump 34 is manually controlled by means of a needle valve 118, and the pump 34 is manually controlled by means of a needle valve 120. The needle valves 118, 120 are mounted on the control panel 24 as shown in FIG. 3, and the needle valves 118, 120 are disposed within a conventional pump control hydraulic circuit only a part of which is schematically illustrated in FIG. 4, but which would be readily known to those skilled in the art.

The liquid additive metering means of the preferred embodiment also includes a gravity flowmeter 122 which is connected between a metering inlet 124 and a metering outlet 126. The flowmeter 122 has an internal ball valve which is manually adjustable to control the rate of flow through the flowmeter, which flow occurs in response to gravity. In the preferred embodiment the flowmeter 122 provides a third selectable range of flows, namely, from about 1 gallon per minute to about 60 gallons per minute. When not in use, the flowmeter 122 is disconnected from any of its selectable connections and stored in or carried ón the truck 2, such as in the storage compartment 56 or in the cab 8.

Although in the preferred embodiment two pumps and one gravity flowmeter are used, it is contemplated that different numbers or equipment can be used. For whatever means for moving substances at controlled rates are used, they are to include suitable means for indicating the operation thereof. Specifically, for the pumps 34, 36, they provide electrical signals indicating the number of pump revolutions per unit of time by which flow rates of the fluids pumped thereby can be calculated. For the flowmeter 122, an electrical signal corresponding to the flow rate is also provided. These signals, and how they are generated, are of types known to the art.

The present invention also includes connector means for connecting one or more of the tanks 86, 88, 90, 92 to one or more of the metering components 34, 36, 122 of the liquid additive metering means, and the present invention also includes connector means for connecting one or more of the components 34, 36, 122 to one or more of the additive inlets 80, 82, 84 of the mixing system. This allows great versatility in the present invention in that one or more selected liquid additives can be pumped or otherwise flowed at one or more selected flow rates into one or more selected inlets of the mixing system.

In the preferred embodiment, a flexible hose 128 having quick-connect coupling means on each end is used to connect a selected one of the additive outlets 102, 104, 106, 108 to a selected one of the metering inlets 110, 114, 124. Other hoses of this same type can be used to connect other additive outlets to other metering inlets in any desired combination. Any selected interconnecting arrangement can be changed, and readily so in the preferred embodiment wherein quick(-)connect couplings are used on the ends of the hoses and on the inlets and outlets.

Similarly, a hose 130 having quick-connect coupling means at both ends is used to connect a selected metering outlet 112, 116, 126 to a selected one of the additive inlets 80, 82, 84 (except, it should be noted, that in the preferred embodiment the metering outlet 126 would only be connected to additive inlet 80 or additive inlet 82 since gravity flow alone would likely be insufficient to introduce the additive into the additive inlet 84 on the pressure side of the pump 62). Additional hosts 130 can be used to provide further interconnections.

Thus, by using one or more hoses 128 and one or more hoses 130, releasable connections are made between the liquid additive storage means and the liquid additive metering means and between the liquid additive metering means and the mixing means to provide for changeable fluid communication throughout this liquid additive portion of the present invention. To enhance this versatility, it is preferred that the spacing between any of the additive outlets 102, 104, 106, 108 and the metering inlets 110, 114, 124 and the spacing between any of the metering outlets 112, 116, 126 and the additive inlets 80, 82, 84 all be within the length of a single size of hose used for the hoses 128, 130 so that only a single size of hose is needed. When not in use, the hoses 128, 130 can be stored in the storage compartments 56, 58.

In addition to the liquid additive metering portion of the present invention, there is a dry additive metering portion which is specifically adapted in the preferred embodiment for metering proppant, such as sand, as is commonly used in preparing fracturing fluids. This is provided by the proppant metering means 42 which includes a gate 132 slidably mounted on the truck 2 in overlying relation to the blending tub 60 as is schematically illustrated in FIG. 4 and as is also apparent from FIG. 2. The gate 132 provides a variable opening, or window, through which a particulate material can be dropped into the blending tub 60. The size of the opening controls the rate at which the particulate material is added.

Figure 5:
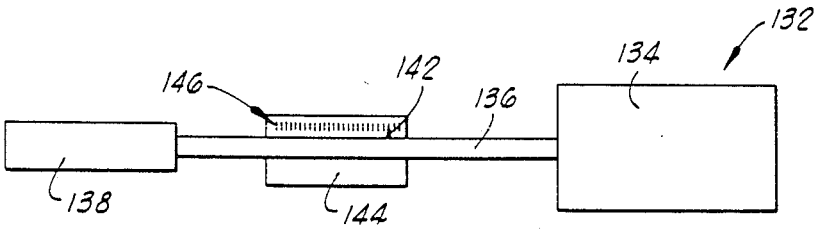
FIG. 5 is a schematic illustration of a proppant gate subassembly of the apparatus shown in FIGS. 1 and 2.

Referring to FIG. 5, the gate 132 is schematically illustrated as including a door 134 connected by a bar or rod or other suitable connector 136 to the piston of a hydraulic cylinder 138. The hydraulic cylinder 138 is connected into a hydraulic system of a known type which is controlled in response to manual movement of a lever 140 represented in FIG. 4 and shown in FIG. 3 connected to the side of the control panel housing 26. Thus, movement of the piston within the cylinder 138 in response to movement of the lever 140 moves the door 134 to adjust the size of the window or opening through which the dry additive is to be dumped.

Connected to the rod 136 is a pointer or other indicator member 142 (see FIG. 5) which, with the bar 136, moves relative to a scale 144 having flow rate indicia 146 marked thereon. In the preferred embodiment, the indicia 146 are calibrated in sacks per minute. That is, when the pointer 142 coincides with a particular marking of the indicia 146, that designates the rate of dry additive, in sacks per minute, which can be dumped into the blending tub 60 through the opening defined by that positioning of the door 134 relative to a stationary frame structure 148 which is schematically shown in FIG. 4 in association with the door 134.

For use in controlling the operation of the present invention, the invention further includes the components of the control panel 24 pertinent to the circuit shown in FIG. 4. These components include the needle valves 118, 120, which provide manual control of the pumps 34, 36, respectively. These components also include the lever 140 which provides manual control of the gate 132. These manual controls are manipulated by an operator in response to control information displayed by a monitoring means 150 also mounted on the control panel 24. The locations of these components on the control panel 24 are shown in FIG. 3.

The monitoring means 150 includes two computer and display units 152, 154 depicted in both FIGS. 3 and 4. The units 152, 154 are the same devices as those disclosed in U.S. Pat. Application Ser. No. 846,533 and U.S. Pat. Application Ser. No. 847,397, both filed Mar. 31, 1986 and assigned to the assignee of the present invention, both of which applications are incorporated herein by reference. Although the units 152, 154 are the same as those disclosed in the aforementioned applications, the units 152, 154 include simple programming changes which one skilled in the art can readily make to implement the functions to be performed by the units 152, 154 as disclosed herein.

The computer and display unit 152 is connected to receive an electrical signal from the flowmeter 64, which electrical signal indicates the flow rate of the mixture made within the mixing means 40. The transmission of this signal to the unit 152 is indicated in FIG. 4 by the line 156. Manual entries, indicated at 158 in FIG. 4 and made through a keypad 159, are also made to the unit 152. The manual entries include the desired proppant concentration within the mixture, a proppant coefficient which is a known number for a particular type of proppant which is to be used (e.g., 0.0456 for 20/40 sand), and calibration information. Using the flow rate information from the flowmeter 64 and using the desired proppant concentration information which has been entered, the unit 152 computes and displays, through a visual display 160, a gate position at which the entered desired proppant concentration is to be obtained for the flow rate indicated by the flowmeter 64, which flow rate is displayed in a visual display 162 of the unit 152. The gate position indicia displayed in the display 160 is a scale number to which the gate 132 is to be set. Thus, an operator reading the display 160 then moves the lever 140 within the hydraulic circuit controlling the hydraulic cylinder 138 of the gate 132 to move the door 134 and the attached indicator 142 until the indicator 142 is aligned with the scale marking of the indicia 146 corresponding to that shown in the display 160.

For performing the aforementioned functions, the unit 152 includes a microcomputer 164 interconnected with the keypad 159 and the displays 160, 162. In addition to performing the aforementioned functions, the microcomputer 164 computes and transmits an electrical signal representing a clean mixture flow rate of the mixture flowing through the flowmeter 64 compensated to delete the dry additive or particulate material component (i.e., the proppant for the described preferred embodiment) of that mixture. That is, the signal received from the flowmeter 64 represents the flow rate of the "dirty" fluid containing all of the mixed components, but a "clean" flow rate value is needed for calculating actual concentrations of liquid additive contained in that "clean" flow. To make this compensation, the microcomputer 164 is programmed to implement the following equation:

clean flow rate value = (dirty flow rate of the flow of the mixture as detected by the flowmeter 64)/(1 + $XY$), where X = the entered dry additive (e.g., proppant) coefficient and Y = the entered desired dry additive (e.g., proppant) concentration factor.

The resultant clean flow rate value is provided, as indicated at 166 in FIG. 4, to the computer and display unit 154.

The unit 154 receives not only the clean flow rate value but also the flow rate indicating signals from the pumps 34, 36 and from the flowmeter 122 as indicated at 168, 170, 172 in FIG. 4. These electrical signals, received by suitable known means within the unit 154, are used by a microcomputer 174 of the unit 154 for computing and displaying the concentrations of the additives being metered by the pumps 34, 36 or the flowmeter 122. The computed actual concentration values or indicia are displayed through displays 176, 178 connected to the microcomputer 174 (as is a keypad 180). The microcomputer 174 is also connected in communication with the microcomputer 164 to receive the clean flow rate value as indicated at 166 in FIG. 4.

The concentration information is determined by dividing the individual additive flow rate information by the clean flow rate value, and any needed scaling adjustments are made to display the information in units of gallons per 1,000 gallons. The microcomputer 174 is also programmed to totalize gallons of additive which have been added throughout the job, which totals can also be displayed through the displays 176, 178. In the preferred embodiment of the present invention, only two additives can be monitored and displayed through the displays 176, 178 at one time; however, it is contemplated that other embodiments could be developed to display more than two.

Once the actual concentration values have been computed and displayed through one or both of the displays 176, 178, the operator of the embodiment manually adjusts the needle valves 118, 120 or the internal valve of the flowmeter 122 as needed until the displayed concentration values are at whatever the desired concentration values are.

To use the present invention, the liquid additive tanks 86, 88, 90, 92 are filled as needed with the suitable additives, and any needed dry additives are loaded on the pallet 16. The truck 2 is then driven to the well site. Thus, all the needed equipment and additives are transported to the well site on a single vehicle.

Once at the well site, the base fluid, such as water, is provided through a suitable connection with the conduit 72 and the valve 74 which are carried on the truck 2. Also at the well site, each hose 128 to be used is manually connected to a selected respective one of the additive outlets 102, 104, 106, 108 and a selected respective one of the metering inputs 110, 114, 124 as needed to accomplish the desired job. Additionally, each hose 130 to be used is manually connected, at the well site, with a selected respective one of the metering outlets 112, 116, 126 and a selected respective one of the additive inlets 80, 82, 84 as needed. Needed manual entries 158 are made in the unit 152 through the keypad 159. The system is operated to produce a mixture by flowing any connected liquid additives into the selected additive inlet(s) of the mixing means 40 and by dropping any needed dry material through the gate 132 into the blending tub 60 of the mixing means 40. The addition of these substances is controlled at the well site through manual manipulation of the needle valves 118, 120 and the lever 140 in response to the additive concentration indicia displayed through the displays 176, 178 and the gate position indicia displayed through the display 160. This provides in the mixing means, for output through the flowmeter 64, a mixture having a desired concentration of the selected one or more liquid additives and any dry additive.

More specifically, the concentration of the dry additive is controlled by setting the size of the opening or window defined above the blending tub 60 by the positioning of the door 134 of the gate 132 and then pouring the dry additive, such as proppant, through the opening and into the tub 60 so that the mixing means 40 mixes a controlled amount of the dry additive into the mixture. To set the size of the opening, the desired concentration factor for the dry additive is entered into the microcomputer 164 (as part of the manual entries 158), the flow rate of the mixture is determined by the microcomputer 164 based on the signal received from the flowmeter 64, a desired flow rate of the dry additive is calculated by the microcomputer 164 in response to the desired concentration factor and the flow rate of the mixture, indicia representing the calculated desired flow rate of the dry additive is displayed, and an operator manually adjusts the gate 132 in response to the displayed indicia so that the size of the opening defined above the tub 60 will allow the indicated flow of dry additive to be obtained.

To control the liquid additive metering means, the microcomputer 164 calculates a clean flow rate in response to the aforementioned equation $CFR = DFR/(1+XY)$, where CFR equals clean flow rate, DFR equals the determined flow rate of the mixture based on the signal from the flowmeter 64, X equals the entered dry additive coefficient (entered with the manual entries 158), and Y equals the entered desired dry additive concentration factor (also entered with the manual entries 158). The microcomputer 164 provides the clean flow rate value to the microcomputer 174. The microcomputer 174 determines the flow rate of each metered liquid additive whose concentration is to be calculated. The microcomputer 174 also calculates the concentration of that metered liquid additive in response to the clean flow rate value provided from the microcomputer 164 and from the flow rate of the metered liquid additive as determined by the microcomputer 174. The microcomputer 174 displays a calculated concentration of the metered liquid additive, and an operator manually adjusts the operation of the component of the liquid additive metering means by which that additive is being metered until the displayed calculated concentration of that additive equals a desired concentration thereof.

Thus, the present invention is well adapted to carry out the objects and attain the ends and advantages mentioned above as well as those inherent therein. While a preferred embodiment of the invention has been described for the purpose of this disclosure, changes in the construction and arrangement of parts and the performance of steps can be made by those skilled in the art, which changes are encompassed within the spirit of this invention as defined by the appended claims.

What is claimed is:

1. An apparatus for adding a selected additive into a mixture, comprising:

first container means for storing a first additive, said first container means including a first additive outlet;

second container means for storing a second additive, said second container means including a second additive outlet;

first metering means for moving a substance at a controlled rate, said first metering means including a first metering inlet and a first metering outlet;

second metering means for moving a substance at a controlled rate, said second metering means including a second metering inlet and a second metering outlet;

mixing means for mixing a plurality of substances into a mixture, said mixing means including a plurality of additive inlets;

first connector means for changeably connecting the respective additive outlet of a selected one of said first and second container means to the respective metering inlet of a selected one of said first and second metering means for communicating the respective additive from the selected one of said first and second container means to the selected one of said first and second metering means to be the substance moved thereby; and second connector means for changeably connecting the respective metering outlet of the selected one of said first and second metering means to a selected one of said plurality of additive inlets of said mixing means for communicating the selected one of said first and second metering means with said mixing means through the selected one of said plurality of additive inlets, thereby for providing the respective additive of the selected one of said first and second container means as a substance to be mixed in said mixing means.

2. An apparatus as defined in claim 1, wherein:

said first connector means includes a first hose including coupling means for releasably coupling to the respective additive outlet of the selected one of said first an second container means, and coupling means for releasably coupling to the respective metering inlet of the selected one of said first and second metering means; and said second connector means includes a second hose including coupling means for releasably coupling to the respective metering outlet of the selected one of said first and second metering means, and coupling means for releasably coupling to the selected one of said plurality of additive inlets of said mixing means.

3. An apparatus as defined in claim 2, further comprising a truck having said first and second container means, said first and second metering means and said mixing means mounted thereon, said truck including storage means for receiving said first hose when said coupling means thereof are released from the respective additive outlet and the respective metering inlet and for receiving said second hose when said coupling means thereof are released from the respective metering outlet and the selected one of said plurality of additive inlets.

4. An apparatus as defined in claim 1, wherein:

said mixing means includes:

a blending tub;

a pump;

a flowmeter;

first conduit means for conducting a fluid flow from said blending tub to said pump; and second conduit means for conducting a fluid flow from said pump to said flowmeter; and said plurality of additive inlets include:

first coupling means, communicated into said blending tub, for releasably coupling with said second connector means;

second coupling means, communicated into said first conduit means, for releasably coupling with said second connector means; and third coupling means, communicated into said second conduit means, for releasably coupling with said second connector means.

5. An apparatus as defined in claim 4, wherein:

said apparatus further comprises a truck having said mixing means mounted thereon;

said first container means includes a first tank mounted on said truck;

said second container means includes a second tank mounted on said truck;

said first metering means includes a first additive pump mounted on said truck;

said second metering means includes a second additive pump mounted on said truck;

said first connector means includes a first hose, carried on said truck, for connecting a selected one of said first and second tanks in fluid communication with a selected one of said first and second pumps; and said second connector means includes a second hose, carried on said truck, for connecting the selected one of said first and second pumps to a selected one of said first, second and third coupling means.

6. An apparatus as defined in claim 5, further comprising:

gate means, mounted on said truck in overlying relation to said blending tub, for providing a variable opening through which a particulate material can be dropped into said blending tub;

monitoring means, mounted on said truck, for monitoring said first metering means, said second metering means and said flowmeter and for providing control information in response thereto, said control information including gate means position indicia and additive concentration indicia;

first manual control means, mounted on said truck, for moving, in response to manual control by an operator, said gate means to the gate means position indicated by said gate means position indicia; and second manual control means, mounted on said truck, for controlling, in response to manual control by an operator, the selected one of said first and second pumps to operate at a rate which delivers additive so that the additive concentration indicia provided by said monitoring means equals a desired concentration of the additive.

7. An apparatus as defined in claim 1, wherein:

said first metering means includes a pump connected between said first metering inlet and said first metering outlet; and said second metering means includes a gravity flowmeter connected between said second metering inlet and said second metering outlet.

8. An apparatus as defined in claim 1, wherein:

said apparatus further comprises a truck having said mixing means mounted thereon;

said second container means includes a second tank mounted on said truck;

said first metering means includes a first pump mounted on said truck;

said second metering means includes a second pump mounted on said truck;

said first connector means includes a first hose, carried on said truck, for connecting a selected one of said first and second tanks in fluid communication with a selected one of said first and second pumps; and said second connector means includes a second hose, carried on said truck, for connecting the selected one of said first and second pumps to a selected one of said plurality of additive inlets.

9. An apparatus as defined in claim 1, wherein:

said mixing means includes a blending tub; and said apparatus further comprises:

gate means, mounted in overlying relation to said blending tub, for providing a variable opening through which a particulate material can be dropped into said blending tub;

monitoring means for monitoring said first metering means, said second metering means and said mixing means and for providing control information in response thereto, said control information including gate means position indicia and additive concentration indicia;

first manual control means, responsive to manual control by an operator, for moving said gate means to the gate means position indicated by said gate means position indicia; and second manual control means, responsive to manual control by an operator, for controlling the selected one of said first and second metering means to operate at a rate which delivers additive so that the additive concentration indicia provided by said monitoring means equals a desired concentration of the additive.

10. An apparatus as defined in claim 9, wherein said monitoring means includes:

a first computer and display unit, comprising:

means for receiving an electrical signal indicating a flow rate of the mixture;

means for receiving a manually input electrical signal indicating a desired concentration of particulate material within the mixture;

means, responsive to the indicated flow rate and the indicated desired concentration, for computing and displaying a gate means position at which the indicated desired concentration of particulate material is obtained for the indicated flow rate; and means, responsive to the indicated flow rate and the indicated desired concentration, for computing and transmitting an electrical signal representing a clean mixing flow rate of the mixture compensated to delete the particulate material component of the mixture; and a second computer and display unit, comprising:

means for receiving from said first computer and display unit the electrical signal representing a clean mixture flow rate;

means for receiving from said first and second metering means electrical signals representing flow rates of additives moved by said first and second metering means; and means, responsive to the represented clean mixture flow rate and the represented flow rates of additives, for computing and displaying the concentrations of the represented additives in the mixture.

11. A portable apparatus for mixing a liquid additive and a proppant with a base fluid to prepare at a well site a mixture for use in a well, said apparatus comprising:

liquid additive storage means for providing a reservoir for a liquid additive;

liquid additive metering means for providing a controlled rate flow of a liquid additive from said liquid additive means;

proppant metering means for providing a controlled rate flow of a proppant;

mixing means for receiving the controlled rate flow of a liquid additive and the controlled rate flow of a proppant and for mixing the controlled rate flows with a flow of a base fluid to provide a flow of a mixture;

first computer means, including means for receiving a desired proppant concentration factor and responsive to said mixing means and to a received desired proppant concentration factor, for computing information with which to control said proppant metering means and for computing a clean flow rate value for the mixture excluding the proppant; and second computer means, responsive to the clean flow rate value and to said liquid additive metering means, for computing a liquid additive concentration value with which to control said liquid additive metering means.

12. An apparatus as defined in claim 11, wherein:

said first computer means includes:

a first keypad for entering a desired proppant concentration factor;

a first display for displaying a rate of flow of the flow of mixture provided by said mixing means;

a second display for displaying, as the information with which to control said propant pant metering means, a scale number corresponding to a position setting of said proppant metering means for obtaining the desired proppant concentration designated by an entered and received desired propant concentration factor; and a first microcomputer connected to said first keypad and said first and second displays, said first microcomputer including said means for receiving a desired propant concentration factor; and said second computer means includes:

a second keypad;

a third display for displaying a first computed liquid additive concentration value;

a fourth display for displaying a second computed liquid additive concentration value; and a second microcomputer connected to said second keypad and to said third and fourth displays and connected in communication with said first microcomputer.

13. An apparatus as defined in claim 11, wherein said first computer means includes a microcomputer programmed for calculating a clean flow rate value for the mixture excluding the proppant in response to:

clean flow rate value=(flow rate of the flow of the mixture)/(1+XY), where

X=a proppant coefficient received by said microcomputer and

Y=a desired proppant concentration factor received by said microcomputer.

14. An apparatus as defined in claim 11, wherein:

said liquid additive storage means includes a plurality of additive outlets;

said liquid additive metering means includes a plurality of metering inlets and a plurality of metering outlets and means for communicating said plurality of metering inlets and said plurality of metering outlets;

said mixing means includes a plurality of additive inlets; and said apparatus further comprises:

first connector means for connecting a selected one of said additive outlets to a selected one of said metering inlets; and second connector means for connecting a selected one of said metering outlets to a selected one of said additive inlets.

15. An apparatus as defined in claim 11, further comprising a truck including:

a driver's cab;

a wheel-mounted chassis having said cab, said liquid additive storage means, and said liquid additive metering means mounted thereon;

lift means, having said mixing means and said proppant metering means mounted thereon and connected to said chassis, for moving said mixing means and said proppant metering means between a raised position adjacent said chassis and a lowered position adjacent ground upon which said truck sits; and a control panel mounted on said chassis and having said first and second computer means mounted therein.

16. An apparatus as defined in claim 15, wherein:

said mixing means includes a tub mounted on said lift means; and said proppant metering means includes a gate disposed above said tub and hydraulically adjust able to a selected position relative to said tub in response to the computed information with which to control said proppant metering means to define a window of adjustable size, through which window the controlled rate of flow of a proppant is provided.

* * * * *

UNITED STATES PATENT AND TRADEMARK OFFICE

CERTIFICATE OF CORRECTION

PATENT NO. : 4,886,367

DATED : December 12, 1989

INVENTOR(S) : Dale E. Bragg et al.

It is certified that error appears in the above-identified patent and that said Letters Patent is hereby corrected as shown below:

In column 15, line 3, insert therefore --said first container means includes a first tank mounted on said truck;--.

In column 16, line 44, delete the word [pant].

Signed and Sealed this

Twenty-second Day of September, 1992

*Attest:*

DOUGLAS B. COMER

*Attesting Officer*

*Acting Commissioner of Patents and Trademarks*